US008808815B2

(12) United States Patent
Hood et al.

(10) Patent No.: US 8,808,815 B2
(45) Date of Patent: Aug. 19, 2014

(54) INKJET-RECEPTIVE ARTICLE

(75) Inventors: David K. Hood, Basking Ridge, NJ (US); Surya Kamin, Skillman, NJ (US); Karyn Visscher, Morris Plains, NJ (US)

(73) Assignee: ISP Investments Inc., Wilmington, DE (US)

( * ) Notice: Subject to any disclaimer, the term of this patent is extended or adjusted under 35 U.S.C. 154(b) by 268 days.

(21) Appl. No.: 13/218,900

(22) Filed: Aug. 26, 2011

(65) Prior Publication Data

US 2012/0027964 A1 Feb. 2, 2012

Related U.S. Application Data

(63) Continuation-in-part of application No. 11/546,067, filed on Oct. 11, 2006, now abandoned.

(60) Provisional application No. 61/377,778, filed on Aug. 27, 2010.

(51) Int. Cl.

| | |
|---|---|
| ***B41M 5/40*** | (2006.01) |
| ***D06P 5/30*** | (2006.01) |
| ***B41M 5/52*** | (2006.01) |
| ***B41M 5/50*** | (2006.01) |

(52) U.S. Cl.

CPC ..... *D06P 5/30* (2013.01); *B41M 5/5218* (2013.01); *B41M 5/508* (2013.01); *B41M 5/52* (2013.01); *B41M 5/506* (2013.01); *B41M 5/5254* (2013.01)

USPC ..... 428/32.16; 428/32.21; 428/32.34; 428/32.38

(58) Field of Classification Search

CPC ..... D06P 5/30; B41M 5/5218; B41M 5/508; B41M 5/52; B41M 5/506; B41M 5/5254

USPC ..... 428/32.16, 32.21, 32.34, 32.38

See application file for complete search history.

(56) References Cited

U.S. PATENT DOCUMENTS 6,592,953 B1 * 7/2003 Ceruti et al. ..... 428/32.24

* cited by examiner

*Primary Examiner* — Betelhem Shewareged

(74) *Attorney, Agent, or Firm* — William J. Davis

(57) ABSTRACT

An inkjet-receptive article comprising a substrate having a coating thereon comprising a vinyl lactam polymer or copolymer and a polymer resin diluent coated from a solvent. A preferred vinyl lactam copolymer is polyvinylcaprolactam (PVCap)—vinyl acetate (VA). Also disclosed are solvent-based compositions for forming an inkjet-receptive coating on a substrate comprising: (i) a vinyl lactam polymer or copolymer; (ii) a solvent; (iii) optionally, a pigment; and (iv) polymer resin diluent.

9 Claims, No Drawings

INKJET-RECEPTIVE ARTICLE

The disclosures in U.S. Provisional Patent Application Ser. No. 60/730,133, filed Oct. 25, 2005, and U.S. patent application Ser. No. 11/546,067, filed Oct. 11, 2006, are hereby incorporated by reference.

FIELD OF THE INVENTION

The present application relates to inkjet printing, and, more particularly, to an inkjet-receptive article which includes a substrate coated with a vinyl lactam polymer or copolymer.

BACKGROUND OF THE INVENTION

Printing on paper has attained considerable commercial success in the computer industry. However, printing onto substrates such as plastics, e.g. vinyl, polyester or polyolefin, and the like, remains a technical challenge for a variety of printing techniques, especially when comparing synthetic print performance to the print quality, print integrity and adhesion commonly recognized as standards for paper substrates.

U.S. Pat. No. 6,471,757 assigned to Canon Kabushiki Kaisha discloses an ink that has a dye and a pigment. The pigment is a self-dispersant type pigment and an anionic dye in which at least one anionic group is bound on a surface of the pigment directly or through another atomic group and having a Ka value of less than 1 $ml.m^{-2}.msec^{-1/2}$ according to a Bristow method. An image having an excellent image quality is formed by using such an ink in the process of ink jet recording.

US Patent Publication No. 20020094418 discloses an inkjet recording element comprising a support having thereon in order: a) a hydrophilic, fluid-absorbing layer, and b) an image-receptive layer capable of retaining an inkjet image, the image-receiving layer comprising an open-pore membrane of a mixture of a water-insoluble polymer and a water-absorbent polymer, the mixture containing at least about 25% by weight of the water-absorbent polymer.

US Patent Publication No. 20020136868 discloses an inkjet recording medium having, on a base material, a porous resin layer containing water-dispersible resin particles B having a minimum film-forming temperature of not lower than 0° C., and water-dispersible resin particles A having a minimum film-forming temperature higher than the film-forming temperature of the water-dispersible resin particles B and having an average particle size larger than the average particle size of the water-dispersible resin particles B.

Accordingly, it is an object of the present application to provide a polymer which is capable of providing a suitable print receptive film surface or a coating vehicle suitable as an ink.

Another object of the present application is to provide a suitable composition for forming an inkjet-receptive coating on a plastic substrate.

Yet another object of the present application is to provide an article which is suitable for both solvent-based and water-based technologies.

SUMMARY OF THE INVENTION

It is a principal aspect of the present application to provide an inkjet-receptive article comprising a substrate having a coating thereon comprising a vinyl lactam polymer or copolymer.

In accordance with certain aspects, the present application is directed to articles related to printing and coating vehicles suitable for preparing coated articles. The article can be a coated substrate suitable for receiving a printing ink, such as an inkjet-receptive article or a coating vehicle suitable as a printing ink or coating that is applied to a substrate. Both print and coating approaches incorporate a vinyl lactam polymer or copolymer. The preferred vinyl lactam copolymer is polyvinylcaprolactam (PVCap)—vinyl acetate (VA) having a molecular weight of about 6,000 g/mol to about 40,000 g/mol.

Accordingly, one aspect of the present application is to employ a polymer suitable for providing a print receptive film surface or a coating vehicle suitable as an ink, and wherein said print receptive film that includes a plastic substrate coated with a vinyl lactam polymer or copolymer, having advantageous properties suitable for commercial use.

In a preferred aspect of the present application, a substrate is selected from the group consisting of vinyl plastic, polyester plastic, polyolefin plastic, paper, canvas, glass, ceramic, wood or metal.

Another aspect of the present application is to provide the ink coating vehicle such as a colored fluid or wax comprising a vinyl lactam polymer or copolymer, which can be applied to a plastic substrate having advantageous properties suitable for commercial use.

According to some aspects of this application, the article is suitable for both solvent-based and water-based technologies.

Yet another aspect of the present application is to provide a solvent-based composition for forming an inkjet-receptive coating on a substrate comprising: (a) a vinyl lactam polymer or copolymer; (b) a solvent; (c) optionally, a pigment; and (d) a polymer resin diluent.

In accordance with some aspects of the application, the solvent based composition comprises at least one or more components selected from the group consisting of pigment, diluent, polymer resin, surfactant, reactive solvent, non-reactive solvent, plasticizers, wax, driers, chelating agents, antioxidants, deodorants, biocides, fluorescent agents, reflecting agents, and/or fragrances.

DETAILED DESCRIPTION OF THE INVENTION

While this specification concludes with claims particularly pointing out and distinctly claiming that, which is regarded as the invention it is anticipated that the invention can be more readily understood through reading the following detailed description of the invention and study of the included examples.

The singular forms "a," "an," and "the" include plural referents unless the context clearly dictates otherwise specified or dearly implied to the contrary by the context in which the reference is made. The claim "Comprising" and "Comprises of" includes the more restrictive claims such as "Consisting essentially of" and "Consisting of".

The term "about" can indicate a difference of 10 percent of the value specified. Numerical ranges as used herein are meant to include every number and subset of numbers enclosed within that range, whether particularly disclosed or not. All percentages, parts, proportions and ratios as used herein, are by weight of the total composition, unless otherwise specified.

All percentages, parts, proportions and ratios as used herein, are by weight of the total composition, unless otherwise specified. All such weights as they pertain to listed ingredients are based on the active level and, therefore, do not include solvents or by-products that may be included in commercially available materials, unless otherwise specified.

All references to singular characteristics or limitations of the present invention shall include the corresponding plural characteristic or limitation, and vice-versa, unless otherwise specified or clearly implied to the contrary by the context in which the reference is made.

Numerical ranges as used herein are intended to include every number and subset of numbers contained within that range, whether specifically disclosed or not. Further, these numerical ranges should be construed as providing support for a claim directed to any number or subset of numbers in that range.

As used herein, the words "preferred," "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

References herein to "one embodiment," "one aspect" or "one version" or "one objective" of the invention include one or more such embodiment, aspect, version or objective, unless the context clearly dictates otherwise.

All publications, articles, papers, patents, patent publications, and other references cited herein are hereby incorporated herein in their entireties for all purposes to the extent consistent with the disclosure herein.

The term "polymer" refers to a compound comprising repeating structural units (monomers) connected by covalent chemical bonds. The definition includes oligomers as well. Polymers may be further derivatized (example by hydrolysis), crosslinked, grafted or end-capped. Non-limiting examples of polymers include copolymers, terpolymers, quaternary polymers, and homologues. A polymer may be a random, block, or an alternating polymer, or a polymer with a mixed random, block, and/or alternating structure. Polymers may further be associated with solvent adducts.

The term "copolymer" refers to a polymer consisting essentially of two different types of repeating structural units (monomers). The definition includes copolymers having solvent adducts.

The term "free radical addition polymerization initiator" refers to a compound used in a catalytic amount to initiate a free radical addition polymerization. The choice of an initiator depends mainly on its solubility and decomposition temperature.

"Polymerize" and "cure" are interchangeable and mean to polymerize the coating composition. The polymerization or curation may alter the physical state of the composition, to make it transform from a fluid to less fluid state, to go from a tacky or non-tacky state, to go from a soluble to insoluble state, or to decrease the amount of polymerizable monomer by its consumption in a reaction.

The term "acrylates" includes both acrylates (e.g., derived from acrylic acid) and methacrylates (e.g., derived from methacrylic acid). Analogously, the term "acrylamides" includes acrylamides, methacrylamides and polyacrylamides.

The term "print" used in the present application denotes not only imparting an image having the meaning of text or graphics to a printing medium but also imparting an image that does not have the meaning of a pattern or the like.

Described herein are articles related to printing. The article can be a coated substrate suitable for receiving a printing ink, such as an inkjet-receptive article, or a coating vehicle suitable as a printing ink that can be applied to a substrate. Preferably, an inkjet-receptive article comprising a substrate having a coating thereon comprising a vinyl lactam polymer or copolymer and a polymer resin diluent coated from a solvent.

According to one embodiment of the present application, the vinyl lactam polymer or copolymer comprises at least one N-vinyl lactam based compounds as monomers. The N-vinyl lactam compounds may, for example, have one or more $C_1$-$C_6$ alkyl substituents, such as methyl, ethyl, n-propyl, isopropyl, n-butyl, sec-butyl, tert-butyl, etc. These include, for example, N-vinyl-2-pyrrolidone, N-vinyl-2-piperidone, N-vinyl-2-caprolactam, N-vinyl-5-methyl-2-pyrrolidone, N-vinyl-5-ethyl-2-pyrrolidone, N-vinyl-6-methyl-2-piperidone, N-vinyl-6-ethyl-2-piperidone, N-vinyl-7-methyl-2-caprolactam, N-vinyl-7-ethyl-2-caprolactam N-vinyl-2-valerolactam, 4-methyl-N-vinyl-2-pyrrolidone, 3,5-dimethyl-N-vinyl-2-caprolactam, N-vinyl-hexahydro-2-azepinone, N-vinyl-octahydro-2-azocinone, N-vinyl octahydro-2-azoninone and N-vinyl decahydro-2-azecinone, etc. Preference is given to using N-vinyl-2-caprolactam.

Acrylate based comonomers useful for preparing the vinyl lactam polymer or copolymer include N-tert-butylaminoethyl(meth)acrylate, N,N-dimethylaminomethyl(meth)acrylate, N,N-dimethylaminoethyl(meth)acrylate, N,N-diethylaminoethyl(meth)acrylate, N,N-dimethylaminopropyl (meth)acrylate, N,N-diethylaminopropyl(meth)acrylate, N,N-dimethylaminocyclohexyl(meth)acrylate, dimethylaminomethyl acrylate, diethylaminomethyl acrylate, dimethylaminoethyl acrylate, dimethylaminobutyl acrylate, dimethylaminobutyl methacrylate, dimethylaminoamyl methacrylate, diethylaminoamyl methacrylate, dimethylaminohexyl acrylate, diethylaminohexyl methacrylate, dimethylaminooctyl acrylate, dimethylaminooctyl methacrylate, diethylaminooctyl acrylate, diethylaminooctyl methacrylate, dimethylaminodecyl methacrylate, dimethylaminododecyl methacrylate, diethylaminolauryl acrylate, diethylaminolauryl methacrylate, dimethylaminostearyl acrylate, dimethylaminostearyl methacrylate, diethylaminostearyl acrylate and diethylaminostearyl methacrylate. Particularly useful are N-tert-butylaminoethyl(meth)acrylate, N,N-dimethylaminoethyl(meth)acrylate, N,N-dimethylaminoethyl acrylate and N,N-dimethylaminoethyl methacrylate (DMAEMA).

The suitable amide based comonomers for preparing vinyl lactam polymer or copolymer include but not limited to α,β-ethylenically unsaturated mono and dicarboxylic acids with diamines having at least one primary or secondary amino group in it. The most appropriate comonomers would include, but not limited to, N-tert-butylaminoethyl(meth)acrylamide, N-[2-(dimethylamino)ethyl]acrylamide, N-[2-(dimethylamino)ethyl]methacrylamide, N-[3-(dimethylamino)propyl]acrylamide, N-[3-(dimethylamino)propyl]methacrylamide, N-[4-(dimethylamino)butyl]acrylamide, N-[4-(dimethylamino)butyl]methacrylamide, N-[2-(diethylamino)ethyl]acrylamide, N-[4-(dimethylamino) cyclohexyl]acrylamide and N-[4-(dimethylamino) cyclohexyl]methacrylamide, N-[12-(dimethylamino) dodecyl]methacrylamide, N-[18-(dimethylamino)octadecyl] methacrylamide, N-[8-(dimethylamino)octyl] methacrylamide, N-[7-(dimethylamino)heptyl]acrylamide, N-[14-(dimethylamino)tetradecyl]acrylamide, N-[3-(dimethylamino)propyl]methacrylamide, N-[3-(diethylamino) propyl]acrylamide, N-(4-(dipropylamino)butyl]methacrylamide, N-[3-(methyl butyl amino)propyl]acrylamide, N-(2-[3-(dimethylamino)propyl]ethyl)acrylamide, N-(4-[4-(diethylamino)butyl]butyl)acrylamide. Special significance is given to N-[3-(dimethylamino)propyl]acrylamide, or N-[3-(dimethylamino)propyl]methacrylamide (DMAPMA).

The preferred vinyl lactam polymer or copolymer include but are not limited to polyvinylcaprolactam (PVCap)—vinyl acetate (VA) copolymer, polyvinylpyrrolidone (PVP)—vinyl acetate (VA) copolymer, polyvinylcaprolactam (PVCap)—N,N-dimethylaminoethyl methacrylate (DMAEMA) copolymer, polyvinylcaprolactam (PVCap)—N-[3-(dimethylamino)propyl]-methacrylamide(DMAPMA) copolymer. The most preferred copolymer of the present application is polyvinylcaprolactam (PVCap)—vinyl acetate (VA) copolymer.

According to one embodiment of the present application the molecular weight of the vinyl lactam based polymer or copolymer is in the range of about 4,000 g/mol to about 40,000 g/mol. The preferred range of molecular weight of the vinyl lactam based polymer or copolymer is 6,000 g/mol to 40,000 g/mol and the most preferred molecular weight range is 6,000 g/mol to 10,000 g/mol.

The suitable substrate of the present application is paper, plastic, textile, metal, canvas, cloth, wood, leather, ceramic utensils, ceramic cups, ceramic tiles, or glass. The paper substrate is plain, coated or treated papers, particularly photographic quality paper. The plastic substrate of the present application is made of polymers selected from the group consisting of transparent or non-transparent polyurethane, polycarbonate, polyethers, polyesters, polyvinyl chloride, polystyrene, polyethylene, polyolefin, vinyl, polyvinyl acetate, silicone rubbers, rubber latex, polyester-polyether copolymers, ethylene methacrylates, silicone, natural and synthetic rubbers, nylon, polyamide or combinations thereof. The plastic objects of the present application can include but not limited to face shields, helmet shields, automotive components, electrical components, films, swim goggles, surgeon face shields, food packaging plastic foil, greenhouse walls, greenhouse roofs, mirrors, wind shields, underwater moving objects, airplane window shields, passenger air-balloons and so on. The glass objects can include window glasses, greenhouse glasses, glass sheets, face shields, optical glasses, optical lenses, polarizing glasses, mirrors, optical mirrors, prisms, quartz glass, parabolic antennas, automobile head beam light glasses, automobile windshields, airplane control light glasses, runway lights and the like. The metal items can include but not limited to freezer doors, condenser pipes, ship hulls, underwater vehicles, underwater projectiles, airplanes and etc. The most preferred substrate of the present application is plastic which is made of vinyl plastic, a polyester plastic, or a polyolefin plastic.

In accordance with one aspect of the present application, the general coating composition comprises: (a) a vinyl lactam polymer or copolymer; (b) a solvent; (c) a pigment, or other colorant such as a dye; and (d) a polymer resin diluent. Wherein said composition optionally includes a surfactant.

For print receptive coatings, the article may include a pigment, e.g. silica, calcium carbonate, alumina, titanium dioxide, or barium sulfate, or mixtures thereof, suitably present in an amount of up to 30 wt. % of the coating, preferably, about 5-about 15 wt. % of the coating.

For a coating ink, the article may include a colored pigment. Examples of yellow colored, organic and inorganic, pigments include C.I. Pigment Yellow 1, C.I. Pigment Yellow 74, azo pigments such as C.I. Pigment 12 and C.I. Pigment Yellow 17 and the like.

Examples of black colored pigments include carbon black, titanium black, aniline black, and the like.

Examples of white colored pigments include basic lead carbonate, zinc oxide, barium sulfate, titanium oxide, silver, white, strontium titanate, and the like.

Examples of red colored pigments include naphthol red (C.I. Pigment Red 2), C.I. Pigment Red 3, C.I. Pigment Red 176 and C.I. Pigment Red 23 and the like.

Examples of green colored pigments include phthalocyanine green (C.I. Pigment Green 7), C.I. Pigment Green 36, and C.I. Pigment Green 1 and the like.

Examples of blue colored pigments include phthalocyanine blue (C.I. Pigment Blue 15:3), C.I. Pigment Blue 15:6, and C.I. Pigment Blue 16 and the like.

Suitably, the solvent-based portion of the composition typically has % solids of 8-50%, preferably 20-30%. The solvent can be volatile and non-reactive and/or non-volatile and reactive and combinations thereof.

Suitably, the solvent-based composition may have a Brookfield viscosity of 1-10000 cps (LVD-It, #61, 30 rpm, 31% scale), particularly 50-5000 cps, and more particularly 60-1500 cps.

According to one embodiment of the present application a solvent may be added. Suitable solvents can be identified in the *Industrial Solvents Handbook,* 4ed. edited by E. W. Flick (Noyes Daya Corp, Park Ridge, N.J., 1991). Additional insight to solvent selection is also available in the *Polymer Handbook,* 4ed. edited by J. Brandrup, E. H. Immergut, and E. A. Grulke (John Wiley, New York, 1999). In the Polymer Handbook, and of particular utility, is *Solubility Parameters Values* by E. A. Grulke. These references are understood to be incorporated herein in their entirety.

Examples of useful, non-reactive solvents that can be used include hydrocarbon solvents (i.e., white spirit and paraffin oils, low and high boiling), aromatic hydrocarbons (toluene, xylene, paraffins, and naphthenes), alcohols (ethanol, n-propyl, isopropyl, n-butyl), alicyclic alcohols (cyclohexanol), glycols (monoethylene, monopropylene, hexylene, diethylene, dipropylene, triethylene), water, glycerin, ketones (acetone, butan-2-one, hexone, isophorone, diacetone alcohol), esters (ethyl acetate, isopropyl acetate, n-butyl acetate), n-methyl-2-pyrrolidone, γ-butyrolactone and the like.

Suitable reactive solvents include but are not limited to 2-hydroxy methyl methacrylate (HEMA), 2-hydroxy ethyl acrylate (HEA), 2-phenoxy ethyl acrylate (PHEA), 2-ethylhexyl-diglycol acrylate, 2-(2-ethoxyethoxy)ethyl acrylate (EOEOEA), lauryl acrylate (LA), Stearyl acrylate (SA), isobornyl acrylate (IBOA), acrylic acid-2-ethylhexyl ester, isodecyl acrylate, acryloyl morpholine (ACMO), cyclic trimethylol-propane formal acrylate (CTFA), 3-(Methacryloylamino)propyl]trimethylammonium chloride (MAPTAC), (3-Acrylamidopropyl)trimethylammonium chloride (APTAC), $C_8$-$C_{10}$ acrylate (ODA), isodecyl acrylate (ISODA), lauryl methacrylate (LM), stearyl methacrylate (SM), 2,2,2-Trifluoroethyl methacrylate, 2-Acrylamido-2-methyl-1-propanesulfonic acid, 2-Acrylamido-2-methyl-1-propanesulfonic acid sodium salt, [2-(Methacryloyloxy)ethyl] dimethyl-(3-sulfopropyl)ammonium hydroxide, [3-(Methacryloylamino)propyl]dimethyl(3-sulfopropyl) ammonium hydroxide inner salt, 1,6-hexanediol diacrylate (HDDA), dipropylene glycol diacrylate (DPGDA), tripropylene glycol diacrylate (TPGDA), 1,4-butanediol diacrylate (BDDA), Tripropylene glycol diacrylate (TPGDA), dipropyleneglycol diacrylate (DPGDA), Tripropylene glycol diacrylate (TRPGDA), 1,9-nonanediol diacrylate (NNDA), neopentyl glycol diacrylate (NPGDA), propoxylated neopentyl glycol diacrylate (NPG2PODA), polyethylene glycol (200) diacrylate (PEG(200)DA), polyethylene glycol (400) diacrylate (PEG(400)DA), polyethylene glycol (600) diacrylate (PEG(600)DA), ethoxylated bisphenol-A diacrylate (BPA2EODA), triethylene glycol diacrylate (TEGDA), triethylene glycol dimethacrylate (TEGDMA), glycerol propoxylated triacrylate (GPTA), diethylene glycol dimethacrylate (DEGDMA), ethoxylated bisphenol-A dimethacrylate (BPA10EODMA), trimethylolpropane triacrylate (TMPTA), pentaerythritol triacrylate (PET3A), ethoxylated tri-methylolpropane triacrylate (TMP3EOTA), propoxylated tri-methylolpropane triacrylate (TMP3POTA), propoxylated glyceryl triacrylate (GPTA), trimethylolpropane trimethylacrylate (TMPTMA), ethoxylated trimethylolpropane trimethacrylate (TMP3EOTMA), 2,2-dionol diacrylate, pentaerythritol tetraacrylate (PETA), neopentylglycol diacrylate hydroxypivalate, 2-acryloyloxyethylphthalic acid, 2-acryloyloxyethyl-2-hydroxyethylphthalic acid, dimethyloltricyclodecane diacrylate, 2-acryloyloxyethylsuccinic acid, nonylphenol ethylene oxide adduct acrylate, methoxypolyethylene glycol acrylate, tetramethylolmethane triacrylate, dipentaerythritol hexaacrylate (DPHA), isocyanate-functional unsaturated acrylic ester resin, urethane diacrylates oligomers, urethane acrylates, modified urethane acrylates, polyester acrylates, modified bisphenol A diacrylate, phenoxy-polyethylene glycol acrylate, bisphenol A propylene oxide modified diacrylate, bisphenol A ethylene oxide adduct diacrylate, pentaerythritol triacrylate hexamethylenediisocyanate, urethane prepolymer, isoamyl acrylate, isomyristyl acrylate, isostearyl acrylate, carbitol acrylate, cyclohexyl acrylate, tetrahydrofurfuryl acrylate, 1,4-butanediol-monoacrylate and/or diglycidyl ether of 1,4-butanediol, and the like. Mixtures of monomers are also envisioned in certain aspects of the present application.

Additional examples that can be used include methyl vinylether, ethyl vinylether, propyl vinylether, n-butyl vinylether, t-butyl vinylether, 2-ethylhexyl vinylether, n-nonyl vinylether, lauryl vinylether, cyclohexyl vinylether, cyclohexylmethyl vinylether, 4-methylcyclohexylmethyl vinylether, benzyl vinylether, dicyclopentenyl vinylether, 2-dicyclopentenoxyethyl vinyl ether, methoxyethyl vinylether, ethoxyethyl vinylether, butoxyethyl vinyl ether, methoxyethoxy vinylether, ethoxyethoxyethyl vinylether, methoxypolyethylene glycol vinylether, tetrahydrofurfuryl vinylether, dodecyl vinylether, diethylene glycol monovinylether, 2-hydroxyethyl vinylether, 2-hydroxypropyl vinylether, 4-hydroxybutyl vinylether, 4-hydroxymethylcyclohexylmethyl vinylether, polyethylene glycol vinylether, chloroethyl vinylether, chlorobutyl vinylether, phenylethyl vinylether, phenoxypolyethylene glycol vinylether, ethylene glycol divinylether, butylenes glycol divinylether, hexanediol divinylether, bisphenol A alkyleneoxide divinylethers, bisphenol F alkyleneoxide divinylethers, propyleneoxide adducts of trimethylolpropane trivinylether, triethylene glycol divinylether, cyclohexane dimethanol divinylether, N-vinyl-2-pyrrolidone (VP), N-vinyl caprolactam (VCap), N-vinyl imidazole (VI), n-vinyl amides, 4-vinyl pyridine, 2-vinyl pyridine, styrene, 5-vinyl-2-norbornene and the like.

Non-limiting examples of suitable monofunctional epoxy compounds include phenyl glycidylether, p-tert-butylphenyl glycidylether, butyl glycidylether, 2-ethylhexyl glycidylether, allyl glycidylether, 1,2-butyleneoxide, 1,3-butadienemonooxide, 1,2-epoxydodecane, epichlorohydrin, 1,2-epoxydecane, styreneoxide, cyclohexeneoxide, 3-methacryloyloxymethylcylcohexeneoxide, 3 -acryloyloxymethylcylcohexeneoxide, 3-vinylcylcohexeneoxide, and the like.

Non-limiting examples of suitable multifunctional epoxy compounds include 3,4-Epoxycyclohexylmethyl-3,4-epoxycyclohexane carboxylate, 3-ethyl-3-((ethyloxetane-3-yl) methoxy)methyl)oxetane, bisphenol A diglycidylether, bisphenol F diglycidylether, bisphenol S diglycidylether, brominated bisphenol A diglycidylether, brominated bisphenol F diglycidylethers, brominated bisphenol S diglycidylether, epoxy novolak resins, hydrogenated bisphenol A diglycidylethers, hydrogenated bisphenol F diglycidylethers, hydrogenated bisphenol S diglycidylethers, 3,4-epoxycyclohexylmethyl-3',4'-epoxycyclohexanecarboxylate, 2-(3,4-epoxycyclohexyl-5,5 -spiro-3,4-epoxy)cyclohexane-meta-dioxane, bis(3,4-epoxycyclohexylmethyl)adipate, vinylcylcohexeneoxide, 4-vinylepoxycyclohexane, bis(3,4-epoxy-6-methylcyclohexylmethyl)adipate, 3,4-epoxy-6-methylcyclohexyl-3',4'-epoxy-6'-methylcyclohexane carboxylate, methylene-bis(3,4-epoxycyclohexane), dicyclopentadiene diepoxide, ethylene glycol di(3,4-epoxycyclohexylmethyl)ether, ethylene bis(3,4-epoxycyclohexanecarboxylate), epoxyhexahydrodioctyl phthalate, epoxyhexahydrodi-2-ethylhexyl phthalate, 1,4-butanediol diglycidylether, 1,6-hexanediol diglycidylether, glycerol triglycidylether, trimethylolpropane triglycidylether, polyethylene glycol diglycidylether, polypropylene glycol diglycidylether, 1,1,3-tetradecadienedioxide, limonenedioxide, 1,2,7,8-diepoxyoctane, 1,2,5,6-diepoxycyclooctane, and the like.

According to one embodiment of the present application, a coated material comprising a reactive solvent is reacted through free-radical polymerization in the presence of a free-radical initiator. A free-radical initiator refers to any chemical moiety which, upon exposure to an appropriate energy source (e.g. light or heat) decomposes into two independent uncharged fragments left with highly reactive one unpaired electron. The contemplated free radical initiators for polymerization would include but are not limited to various derivatives of peroxides, peresters and/or azo compounds. More particularly, the free radical initiator may be selected from the group consisting of dicumyl peroxide, dibenzoyl peroxide, 2-butanone peroxide, teat-butyl perbenzoate, di-tert-butyl peroxide, 2,5-bis(tert-butylperoxy)-2,5-dimethylhexane, bis(tert-butyl peroxyisopropyl)benzene, and tert-butyl hydroperoxide), diacyl peroxides, cumene hydroperoxide, dialkyl peroxides, hydroperoxides, ketone peroxides, monoperoxycarbonates, peroxydicarbonates, peroxyesters, and peroxyketals, including tertiary butyl perbenzoate, tertiary butyl peroctoate in diallyl phthalate, diacetyl peroxide in dimethyl phthalate, dibenzoyl peroxide, 1-hydroxy cyclohexyl-1-phenyl ketone, bis (2,4,6-trimethyl benzoyl)phenyl phosphine, benzoin ethyl ether, 2,2-dimethoxy-2-phenyl acetophenone, di(p-chlorobenzoyl)peroxide in dibutyl phthalate, di(2,4-dichlorobenzoyl)peroxide with dibutyl phthalate, dilauroyl peroxide, methyl ethyl ketone peroxide, cyclohexanone peroxide in dibutyl phthalate, 3,5-dihydroxy-3,4-dimethyl-1,2-dioxacyclopentane, t-butylperoxy(2-ethyl hexanoate), caprylyl peroxide, 2,5-dimethyl-2,5-di(benzoyl peroxy)hexane, 1-hydroxy cyclohexyl hydroperoxide-1, t-butyl peroxy (2-ethyl butyrate), 2,5-dimethyl-2,5-bis(t-butyl peroxy)hexane, cumyl hydroperoxide, diacetyl peroxide, t-butyl hydroperoxide, ditertiary butyl peroxide, 3,5-dihydroxy-3,5-dimethyl-1,2-oxacyclopentane, and 1,1-bis(t-butyl peroxy)-3,3,5-trimethyl cyclohexane and di-(4-t-butyl cyclohexyl) peroxydicarbonate, azo compounds such as azobisisobutyronitrile and azobiscyclohexanenitrile (e.g., 2,2'-azobis(2-methyl-propanenitrile), 2,2'-azobis(2-methylbutanenitrile), and 1,1'-azobis(cyclohexanecarbonitrile)) and the like mixtures and combinations thereof.

Alternatively, any of the free radical initiators described above can be used for thermal based polymerization alone or in an appropriate mixture thereof and wherein, the polymerization reaction is initiated through heat energy. Particular thermal initiators that can be used for the polymerization of polymer include 2,2'-azobis (2,4-dimethylpentanenitrile), 2,2'-azobis (2-methylpropanenitrile), 2,2'-azobis (2-methylbutanenitrile), peroxides such as benzoyl peroxide, and the like. 2,2'-Azobis(isobutyronitrile) is a particularly useful thermal initiator.

Suitably, the print-receptive article may include a diluent, e.g. a polymer resin, as a powder or solution, present in an amount of up to 40 wt. % of the coating, preferably 5-15 wt. %. Examples of suitable copolymers of polymer resin diluents include vinyl chloride/vinyl acetate, a carboxyl-modified vinyl copolymer, an epoxy-modified vinyl copolymer, and a hydroxyl-modified vinyl copolymer, e.g. Dow/UCAR resins.

According to one embodiment of the present application, a plasticizer may be added. Examples of useful plasticizers include abietates, adipates, alkyl pyrrolidones, alkylated caprolactams, benzoates, butyrates, citrates, epoxidized compounds, phthalates, polyester, polyol esters, ricinoleates, sebacates, stearates, and sulphonamides. Additional information can be found in the NPIRI "Raw Materials Data Handbook" (Volume 2).

Examples of suitable plasticizers include phthalate plasticizers selected from the group consisting of alkyl benzyl phthalates, myristyl benzyl phthalate, butyl benzyl phthalate, dibutyl phthalate, bis(2-ethylhexyl)phthalate, dioctyl phthalate, diisobutyl phthalate, dicyclohexyl phthalate, diethyl phthalate, dimethyl isophthalate, bis(organo) 1,2-phthalates, bis(organo) 1,3-phthalates, bis(organo) 1,4-phthalates, alkyl phenyl phthalates, dihexyl phthalate, diisononyl phthalate, diisodecyl phthalate, alkyl aryl phthalate plasticizers, dibenzyl phthalate plasticizers, diaryl phthalate plasticizers.

Examples of phosphates plasticizers such as alkyl aryl phosphates, triaryl phosphates, trialkyl phosphates, tricresyl phosphate, trioctyl phosphates, dibutyl phosphate, polyurethanes, tris(organo)phosphates, tert-butylphenyl diphenyl phosphate, bis(tert-butyl)phenyl diphenyl phosphate, 2-ethylhexyl diphenyl phosphate, isodecyl diphenyl phosphate, triphenyl phosphate, and mixtures thereof.

Examples of esters based plasticizers are di-(2-ethylhexy)-adipate, diisobutyl adipate, glycerol tribenzoate, sucrose benzoate, dibutyl sebacate, dibutyl maleate, polypropylene glycol dibenzoate, neopentyl glycol dibenzoate, dibutyl sebacate, tri-n-hexyltrimellitate, bis(2-ethylhexyl)adipate.

The specific plasticizers of the present application would include but are not limited to triethyl citrate, epoxidized soya bean oils, dimethyl phthalate, glyceryl triacetate, butyl ricinoleate, butyl stearate, n-octyl-2-pyrrolidone, n-dodecyl-2-pyrrolidone, n-cocoyl-2-pyrrolidone, n-hydrogenated tallowyl-2-pyrrolidone. The plasticizer can be present in the range of from about 0.1 to about 20.0%, preferably from about 0.2 to about 10.0%, and more preferably from about 0.25 to about 5.0% of the solvent-based composition.

According to one embodiment of the present application, a wax is optionally added to prepare a solvent based composition for forming an inkjet-receptive coating. The wax for the present application is selected from natural vegetable waxes, natural animal waxes, mineral waxes, synthetic waxes and functionalized waxes. The specific examples of wax would include but not limited to polyethylene, polypropylenes, polytetrafluoroethylene, fatty acid amides (e.g., stearamide), petroleum (e.g., paraffins, slack, scale, jelly, microcrystalline, ceresin, montan, montan esters), alkylated polyvinyl pyrrolidones (alkylated with $C_4$, $C_{12}$, $C_{20}$, $C_{30}$, and the like), carnauba wax, candelilla wax, Japan wax, bayberry wax, beeswax, punic wax, lanolin, lac wax, shellac wax, spermaceti wax, paraffin wax, microcrystalline wax, montan wax, ozokerite wax, ceresin wax, petrolatum wax, petroleum wax, Fischer-Tropsch wax, acrylate wax, fatty acid amide wax, silicone wax, polytetrafluoroethylene wax, polymethylene wax, polyethylene wax, polypropylene wax, chlorinated polypropylenes, chlorinated polyethylenes alone or in combinations thereof. The wax can be present in an amount of from about 1% to about 20%, particularly about 2% to about 10% based on the entire weight of the solvent-based composition.

According to one embodiment of the present application, a drier may be added. Examples of useful driers include oil soluble soaps (formed from octoates, resonates, naphthenates, tallates, linoleates), cobalt, cobalt acetate, manganese, cerium, zirconium, lithium, calcium, zinc, lead acetate, manganese borate and the like.

In a preferred embodiment of this application, the chelating agent employed for the preparation of solvent based compositions is selected from the group comprising polyols, gluconates, sorbitals, mannitols, carbonates, heptonates, hydroxamates, catechols, α-amino carboxylates, alkanolamines, metal-ion sequestrants, hydroxy-carboxylic acids, aminocarboxylic acids, amino polycarboxylic acids, polyamines, polyphosphates, phosphonic acids, crown ethers, amino acids, polycarboxylic acids, cyclodextrin, phosphonates, polyacrylates or polymeric polycarboxylates and condensed phosphates. However, the particular sequestering or chelating agents of the present application would include but are not limited to acetic acid, adenine, adipic acid, ADP, alanine, alanine, albumin, arginine, ascorbic acid, asparagine, aspartic acid, ATP, benzoic acid, n-butyric acid, casein, citraconic acid, citric acid, cysteine, dehydracetic acid, desferri-ferrichrysin, desferri-ferrichrome, desferri-ferrioxamin E, 3,4-dihydroxybenzoic acid, diethylenetriaminepentaacetic acid (DTPA), sodium salts of diethylenetriamineacetic acid, hydroxylpropylenediaminetetraacetic acid (DPTA), dimethylglyoxime, dimethylpurpurogallin, EDTA and sodium salts, formic acid, fumaric acid, globulin, gluconic acid and its alkali metal salts, glutamic acid, glutaric acid, glycine, glycolic acid, glycylglycine, glycylsarcosine, guanosine, histamine, salicylic, pimalic and sulfamic acid, salicylic, glutaric, malonic acid, 1,10-phenanthroline, 2-pyridylacetic acid, 5-formylfuran sulfonic acid, N-tris(hydroxymethyl)methyl-2-aminoethanesulfonic acid, itaconic acid, chelidonic acid, 3-methyl-1,2-cyclopentanedione, glycolamide, histidine, 3-hydroxyflavone, inosine, iron-free ferrichrome, isovaleric acid, itaconic acid, kojic acid, lactic acid, leucine, lysine, maleic acid, malic acid, methionine, methylsalicylate, nitrilotriacetic acid (NTA), ornithine, orthophosphate, oxalic acid, oxystearin, phenylalanine, phosphoric acid, phytate, pimelic acid, pivalic acid, polyphosphate, proline, propionic acid, purine, pyrophosphate, pyruvic acid, riboflavin, salicylaldehyde, salicyclic acid, sarcosine, serine, sorbitol, succinic acid, tartaric acid, tetrametaphosphate, thiosulfate, threonine, trimetaphosphate, triphosphate, tryptophan, uridine diphosphate, uridine triphosphate, n-valeric acid, valine, xanthosine, triethylenetetraaminehexaacetic acid, N,N'-bis(o-hydroxybenzyl)ethylenediamine-N,N'diacteic acid, ethylenebis-N,N'-(2-o-hydroxyphenyl)glycine, acetohydroxamic acid, desferroxamine-B, disulfocatechol, dimethyl-2,3-dihydroxybenzamide, mesitylene catecholamide (MECAM), 1,8-dihydroxynaphthalene-3,6-sulfonic acid, and 2,3-dihydroxynaphthalene-6-sulfonic acid, siderophores molecules, N,N-dicarboxymethyl-2-aminopentanedioic-acid, diethylenetriaminepentaacetic-acid, ethylene-diaminetetraacetates, nitriloacetates or N-(2-hydroxyethyl)nitrilodiacetates), 2,2-dichloropropionic acid, 2,2-dibromobutyric acid, trifluoroacetic acid, tribromoacetic acid, trichloroacetic acid, 2,3-dibromopropionic acid, 2,2-dichlorovaleric acid, 3-nitropropionic acid, triiodoacetic acid, 3(2,2,2-trichloroethoxy)propionic acid, 4-nitro-2-chlorobutyric acid, 2-bromo-2-nitropropionic acid, 2-nitroacetic acid, 2,4-dihydroxyphenyl acetic acid, 2,4-dichlorophenyl acetic acid, 3(2',4'-dibromophenoxy)propionic acid, 3(3',5'-dinitrophenoxy)propionic acid, 3-phenyl-2,3-dibromopropionic acid, 3,5-dinitrosalicylic acid, 3(3'-bromo-4'-nitrophenyl)propionic acid, 3(3',4'-dihydroxyphenyl)propionic acid alone or in combination. Further information on sequestering and chelating agents is disclosed in T. E. Furia, CRC Handbook of Food Additives, $2^{nd}$ Edition, pp. 271-294 (1972), and M. S. Peterson and A. M. Johnson (Eds.), Encyclopedia of Food Science, pp. 694-699 (1978) are incorporated herein by reference in its entirety. Specific examples of preferred chelating agents include ethylenediaminetetra-acetic acid and sodium salts, nitrilotriacetic acid salts, sodium salts of diethylenetriamine-acetic acid, heptonates, alkanolamines, dimethyl glyoxime and the like.

Another embodiment of the present application discloses that anti-oxidant may be added. Examples of useful anti-oxidants include but not limited to 2,6-di-tert-butyl-4-methylphenol, 2-tert-butyl-4,6-di-methylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)4,6-dimethylphenol, 2,6-dioctadecyl-4-methylphenol, 2,4,6-tricyclohexylphenol, 2,6-di-tert-butyl-4-methoxymethylphenol, 2,6-di-nonyl-4-methylphenol, 2,4-dimethyl-6-(1'-methylundec-1'-yl)phenol, 2,4-dimethyl-6-(1'-methylheptadec-1'-yl)phenol, 2,4-dimethyl-6-(1'-methyltridec-1'-yl)phenol, 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate, bis(3,5-di-tert-butyl-4-hydroxyphenyl)adipate, α-tocopherol, β-tocopherol, γ-tocopherol, δ-tocopherol and mixtures thereof. The particularly important anti-oxidants of the present application would include but are not limited to eugenol, hydroquinone, pyrocatechol, guaiacol, butylated hydroxytoluene, butylated hydroxyanisole, methyl ethyl ketoxime, butylaldoxime, cyclohexanone oxime and the like.

A suitable surfactant may be added to prepare solvent based compositions of the present application. Surfactants can also be employed in the presence of defoaming agents such as polydimethyl siloxanes and derivatives thereof. The surfactants for the present application are selected from anionic, cationic, non-ionic or amphoteric in nature.

Examples of useful anionic surfactants would include but are not limited to alkali metal soaps, ammonium salts of long chain fatty acids, aliphates, abietates, hydroxyalkanesulfonates, alkanesulfonates, dialkylsulfosuccinates, straight-chain alkylbenzenesulfonates, branched alkylbenzenesulfonates, alkylnaphthalenesulfonates, alkylphenoxy polyoxyethylene propylsulfonates, salts of polyoxyethylene alkylsulfophenyl ethers, sodium N-methyl-N-oleyltaurates, monoamide disodium N-alkylsulfosuccinates, petroleum sulfonates, sulfated castor oil, sulfated tallow oil, salts of sulfuric esters of aliphatic alkylesters, salts of alkylsulfuric esters, sulfuric esters of polyoxyethylenealkylethers, salts of sulfuric esters of aliphatic monoglycerides, sodium salt of the monosulfated monoglyceride of hydrogenated coconut oil fatty acids, salts of sulfuric esters of polyoxyethylene alkylphenylethers, salts of alkylphosphoric esters, salts of phosphoric esters of polyoxyethylenealkylethers, salts of phosphoric esters of polyoxyethylenealkylphenylethers, partially saponified compounds of styrenemaleic anhydride copolymers, partially saponified compounds of olefin-maleic anhydride copolymers, naphthalenesulfonateformalin condensates, higher alkyl sulfates such as sodium lauryl sulfate, alkyl aryl sulfonates such as sodium dodecyl benzene sulfonate, higher alkyl sulfoacetates, higher fatty acid esters of 1,2-dihydroxy propane sulfonate. The non-ionic surface active agent of the present application is selected from the group consisting of polyethylene oxide chains attached to hydrocarbons, ethylene oxide with various reactive hydrogen-containing compounds reactive therewith having long hydrophobic chains (e.g. aliphatic chains of about 12 to 20 carbon atoms), which condensation products ("ethoxamers") contain hydrophilic polyoxyethylene moieties, such as condensation products of poly(ethylene oxide) with fatty acids, fatty alcohols, fatty amides, polyhydric alcohols (e.g. sorbitan monosterate), polypropyleneoxide (e.g. Pluronic materials), poloxamers, polyoxyethylene sorbitan esters, fatty alcohol ethoxylates, alkylphenol ethoxylates, tertiary amine oxides, tertiary phosphine oxides and/or dialkyl sulfoxides. Suitable amphoteric surfactants include without limitation derivatives of $C_{8-20}$ aliphatic secondary and tertiary amines having an anionic group such as carboxylate, sulfate, sulfonate, phosphate or phosphonates. Useful cationic surfactants are selected from quaternary fatty ammonium halides, acetates, or suphates.

According to one embodiment of the present application, deodorants and/or fragrances may be added. The fragrance, either a natural fragrance or a synthetic fragrance may be used. Examples of useful deodorants and fragrances include amyl and methyl salicylate, vanillin, citron, cedarwood, peppermint, lavender, carnation and the like. The natural fragrances and synthetic fragrances those are taught in U.S. Pat. No. 7,538,149 assigned to Fujifilm corporation can be employed in the compositions of the present application.

The coating described herein can be achieved through drying, curing or polymerizing the two monomer and comonomer of the present application by any appropriate method known or explored in the prior-arts by a person skilled in the art. Particularly, the polymerization is carried out by employing any one of the method disclosed in "*Principles of Polymerization*" $4^{th}$ edition, 2004, Wiley by George Odian and is referred and disclosed herein in its entirety. The preferable techniques or methods employed by the present application to polymerize desired monomer would include UV-radiation, UV-LED, laser beam, electron beam, gamma irradiation, free-radical, cationic, anionic, thermal, exposure to e-beam and/or by employing a high-energy source in presence of suitable photo initiator for the initiation of polymerization. Suitable source of radiation including but not limited to mercury, xenon, halogen, carbon arc lamps, sunlight, and radioactive sources.

The vinyl lactam polymer or copolymer described herein can provide tough, durable, flexible, film-forming properties, as well as improved adhesion to the substrate and reduced tack.

The coating or printing ink described herein can be coated or printed using any method suitable for the specific formulations. Examples of suitable printing techniques include litho, inkjet, flexographic printing, spraying, inkjet printing, forward or reverse roll coating, direct forward gravure coating, screen printing, hand block printing, perrotine printing, engraved copper plate printing, roller printing, cylinder printing, machine printing, stencil printing or digital textile printing and etc.

The most preferable biocides for the present composition would include but are not limited to Iodo-2-propynyl butylcarbamate (IPBC) 1,2,-benzisothiazolin-3-one (BIT), 2-methyl-4-isothiazolin-3-one (MIT), 5-chloro-2-methyl-4-isothiazoline-3-one (CMIT), 2-octyl-4-isothiazoline-3-one (OIT) and/or 4,5-dichloro-2-octyl-4-isothiazoline-3-one (DCOIT).

Further, the present invention is illustrated in detail by way of the below given examples. The examples are given herein for illustration of the invention and are not intended to be limiting thereof.

EXAMPLE 1

Solvent-Based Composition for Inkjet-Printing onto Plastic Substrates

Vinyl Film Prototype Preparation (Solvent-Based):

The coating solution had a solids content of about 24% and a viscosity of 62 cPs using a Brookfield viscometer (LV DV-1+, #61, 30 rpm, 31% scale).

The single layer coating was prepared as follows:

Step 1: Dissolved 2 g of VAGD solid resin diluent (Dow/UCAR*) in 8 g of MEK.

*Acetic acid ethenyl ester polymer with chloroethene and ethanol (solid powder).

Step 2: Added an additional 45 g of MEK.

Step 3: Added 45 g of PVCAP/VA (ISP) (in ethanol).

Step 4: Added 0.02 g Surfadone® LP-100 (ISP) (octyl pyrrolidone).

The coating solution was coated onto vinyl and dried in an air oven at ~90° C. for about 5 minutes.

EXAMPLE 2

Vinyl Solvent Coating Compositions*

| Product | Supplier | Mass | % Solids | Solid Mass (g) | % in Dry Composition |
|---|---|---|---|---|---|
| MEK | Aldrich | 53 | | | |
| UCAR VAGD | Dow | 2 | 100 | 2 | 8.1 |
| PVCAP/VA | ISP | 45 | 50 | 22.5 | 91.8 |
| Surfadone LP-100 | ISP | 0.02 | 100 | 0.02 | 0.1 |
| Total | | 100.02 | | 24.42 | |

*Percent Solids of Coating is ~24.5

EXAMPLE 3

| Product | Supplier | Mass | % Solids | Solid Mass (g) | % in Dry Composition |
|---|---|---|---|---|---|
| MEK | Aldrich | 53 | | | |
| UCAR VAGD | Dow | 2 | 100 | 2 | 7.5 |
| PVCAP/VA | ISP | 45 | 50 | 22.5 | 84.8 |
| SiLCRON G-100 | ISP | 2 | 100 | 2 | 7.5 |
| Surfadone LP-100 | ISP | 0.02 | 100 | 0.02 | 0.1 |
| Total | | 102.02 | | 26.52 | |

*Percent Solids of Coating is ~26

EXAMPLE 4

| Product | Supplier | Mass | % Solids | Solid Mass (g) | % in Dry Composition |
|---|---|---|---|---|---|
| MEK | Aldrich | 53 | | | |
| UCARMAG-527 | Dow | 2 | 100 | 2 | 7.5 |

-continued

| Product | Supplier | Mass | % Solids | Solid Mass (g) | % in Dry Composition |
|---|---|---|---|---|---|
| PVCAP/VA | ISP | 45 | 50 | 22.5 | 84.8 |
| Boehmite (DISPAL 18N4-80) | Sasol | 2 | 100 | 2 | 7.5 |
| Surfadone LP-100 | ISP | 0.02 | 100 | 0.02 | 0.1 |
| Total | | 102.02 | | 26.52 | |

*Percent Solids of Coating is ~26

EXAMPLE 5

| Product | Supplier | Mass | % Solids | Solid Mass (g) | % in Dry Composition |
|---|---|---|---|---|---|
| MEK | Aldrich | 53 | | | |
| UCAR VROH | Dow | 2 | 100 | 2 | 7.5 |
| PVCAP/VA | ISP | 45 | 50 | 22.5 | 84.8 |
| Boehmite (DISPAL 18N4-80) | Sasol | 2 | 100 | 2 | 7.5 |
| Surfadone LP-100 | ISP | 0.02 | 100 | 0.02 | 0.1 |
| Total | | 102.02 | | 26.52 | |

*Percent Solids of Coating is ~26

EXAMPLE 6

Employing the teachings of U.S. Pat. No. 4,418,138 (the contents of which are hereby incorporated by reference) as a guide for the production of a standard black screen-ink, a modified formulation employed the inventive monomer was designed and is presented below:

| Raw Material | Parts (w/w) |
|---|---|
| Catofor 06 | 1.0 |
| 2-(carboxymethoxy)thioxanthone | 0.5 |
| Ethanol | 5.0 |
| Polyethylene glycol 200 diacrylate | 10.5 |
| PVCAP/VA (inventive polymer) | 4.5 |
| Uvecryl P101 | 2.0 |
| 20% Gohsenol KP08 solution | 50.0 |
| Anthrasol Blu-Black 1RD | 0.5 |
| Polyethylene glycol 200 | 1.0 |

Uvecryl P101 is an unsaturated copolymerizeable amino group-containing monomer.
Gohsenol KP08 is a low viscosity polyvinyl alcohol with 25-29% residual acetate groups.

While this invention has been described in detail with reference to certain preferred embodiments, it should be appreciated that the present invention is not limited to those precise embodiments. Rather, in view of the present disclosure, which describes the current best mode for practicing the invention, many modifications and variations would present themselves to those skilled in the art without departing from the scope and spirit of this invention.

What is claim is:

1. The inkjet-receptive article comprising a substrate having a coating thereon comprising a vinyl lactam polymer or copolymer and a polymer resin diluent coated from a solvent wherein said vinyl lactam copolymer is polyvinylcaprolactam (PVCap)-vinyl acetate (VA) having a molecular weight of about 6,000g/mol to about 40,000 g/mol.

2. The inkjet-receptive article according to claim 1 wherein said substrate is vinyl plastic, polyester plastic, polyolefin plastic, paper, canvas, glass, ceramic, wood or a metal.

3. The inkjet-receptive article according to claim 1 comprises a pigment selected from the group consisting of silica, barium sulfate, calcium carbonate, titanium dioxide, alumina, silver alone or in combinations thereof.

4. The inkjet-receptive article according to claim 3 wherein said pigment is present in the range of about 5 wt. % to about 90 wt. % of the solid coating.

5. The inkjet-receptive article according to claim 1 comprising a diluent in an amount of about 5 wt. % to about 80 wt. % of the coating.

6. The inkjet-receptive article according to claim 5 wherein said diluent is a powdered polymer resin selected from the group consisting of vinyl chloride-vinyl acetate copolymer, a carboxyl-modified vinyl copolymer, an epoxy-modified vinyl copolymer, a hydroxyl-modified vinyl copolymer, acrylate based copolymers or mixture thereof.

7. The inkjet-receptive article according to claim 1 further comprising a surfactant in amount of up to 4 wt. % of the coating.

8. The inkjet-receptive article according to claim 7 wherein said surfactant is selected from the group consisting of anionic, cationic, non-ionic, amphoteric, alkali metal soaps, ammonium salts of long chain fatty acids, quaternary fatty ammonium halides, quaternary fatty ammonium acetates, quaternary fatty ammonium suphates, or polyethylene oxide chains attached to hydrocarbons.

9. The inkjet-receptive article according to claim 1, optionally comprising plasticizers, wax, driers, chelating agents, antioxidants, deodorants, biocides, fluorescent agents, reflecting agents, and/or fragrances.

* * * * *